US007383978B2

(12) United States Patent
Michlin et al.

(10) Patent No.: US 7,383,978 B2
(45) Date of Patent: Jun. 10, 2008

(54) BLANK AND METHOD FOR FORMING A NOVELTY PRODUCT

(76) Inventors: Irving R. Michlin, 29 David Rd., Salt Point, NY (US) 12578; Stephen A. Singer, 402 Muriel Ct., Wheeling, IL (US) 60090

( * ) Notice: Subject to any disclaimer, the term of this patent is extended or adjusted under 35 U.S.C. 154(b) by 572 days.

(21) Appl. No.: 10/653,792

(22) Filed: Sep. 3, 2003

(65) Prior Publication Data

US 2004/0050916 A1 Mar. 18, 2004

Related U.S. Application Data

(63) Continuation-in-part of application No. 09/966,039, filed on Sep. 27, 2001, now abandoned.

(51) Int. Cl.
*B42D 15/00* (2006.01)

(52) U.S. Cl. ..... 229/92.8

(58) Field of Classification Search ..... 229/92.8, 229/92.1, 92.3; 283/81, 94, 101, 103, 105, 283/106

See application file for complete search history.

(56) References Cited

U.S. PATENT DOCUMENTS 4,778,153 A * 10/1988 Bachman et al. ..... 283/101
5,230,938 A * 7/1993 Hess et al. ..... 428/42.3
5,389,414 A * 2/1995 Popat ..... 428/40.1
5,518,787 A * 5/1996 Konkol ..... 428/43
5,595,404 A * 1/1997 Skees ..... 283/116
5,752,647 A * 5/1998 Schubert et al. ..... 229/92.1
6,092,841 A * 7/2000 Best et al. ..... 283/56
6,197,396 B1 * 3/2001 Haas et al. ..... 428/40.1
6,294,237 B1 * 9/2001 Popat ..... 428/40.1
6,336,631 B1 * 1/2002 Volkert ..... 273/157 R
6,514,587 B1 * 2/2003 Fernandez-Kirchberger et al. ..... 428/40.1
6,682,099 B1 * 1/2004 Laurash et al. ..... 283/61
6,685,228 B2 * 2/2004 Riley ..... 283/109
6,773,035 B1 * 8/2004 Cox et al. ..... 283/61
6,814,375 B2 * 11/2004 Cox et al. ..... 283/61
6,916,520 B2 * 7/2005 Fernandez-Kirchberger . 428/77

FOREIGN PATENT DOCUMENTS

JP 2003-54165 * 2/2003 ..... 229/92.8

* cited by examiner

*Primary Examiner*—Jes F Pascua
(74) *Attorney, Agent, or Firm*—Francis C. Hand; Carella, Byrne, Bain et al.

(57) ABSTRACT

A single blank is provided with four removable sections which are sub-divided by lines of weakening and fold lines. The blank is foldable along a longitudinal line and transverse line to form the four sections into a four layer product. Upon removable from the blank, the four layer product may be manipulated to expose different sub-sections and, thus, provide different pictorial representations depending upon the imaging of the sub-sections. The sub-sections are imaged in a coordinated manner to produce different scenes.

23 Claims, 4 Drawing Sheets

BLANK AND METHOD FOR FORMING A NOVELTY PRODUCT

This is a Continuation-in-part application of Ser. No. 09/966,039 filed Sep. 27, 2001, now abandoned.

This invention relates to a blank and a method for forming a novelty product.

As is known, various types of novelty products have been made from paper materials to provide various pictorial effects. One known novelty product is in the form of a small rectangular card of multi-layer construction which is divided into foldable sections and imaged differently on each section to present a different pictorial representation when the folded sections are manipulated into different orientations.

It is an object of this invention to provide a blank for making a novelty product as well as a method for forming the novelty product from the blank in a relatively easy and simple manner.

It is another object of the invention to provide a blank form that can be fed into and imaged by an imaging machine, such as, as laser printer, ink jet printer, or other type of imaging machine to receive two or more separated images and subsequently processed to form a laminated construction of the imaged sections of the blank.

In one embodiment, the invention provides a blank that is comprised of a sheet of paper having at least two areas each of which has a removable section for receiving imaging on a front surface. In addition, a layer of adhesive is disposed on at least one of the sections for laminating the two removable sections to each other in back-to-back relation when the sheet of paper is folded on itself to bring the two sections into registration over each other. Further, a removable liner is disposed over the adhesive to prevent inadvertent adhesion to another substrate and to protect the adhesive until use is to be made thereof.

The blank may also be provided with a fold line disposed transversely between the two sections for folding of the two sections onto each other. The fold line facilitates proper registration of the two imaged areas when folding the sheet of paper.

The invention further provides a method of forming a novelty product with the blank. In this respect, with the blank in a flattened condition, imaging is applied to the front surface of each area of the sheet. Thereafter, the liner is removed from the back of the sheet to expose the adhesive and the sheet folded to adhesively secure the two imaged sections together in laminated back-to-back relation. Thereafter, the laminated sections are removed from the remainder of the sheet.

By imaging of one side of a photo quality water-resistant sheet and then folding, laminating and removing the laminated sections, a two-sided trading card may be obtained. Other types of laminated constructions may also be obtained.

In another embodiment, after a blank has been imaged and folded to laminate the imaged sections together, the laminated sections may be die-cut, for example, in a jig-saw puzzle pattern. The resultant laminated construction may then be removed from the remainder of the blank for use as a jig-saw puzzle.

Typically, the imaging applied to each area of the blank is different from and related to the imaging applied to the other of the areas. For example, for a trading card, a photo of an individual may be imaged in one area and statistical information regarding the individual may be imaged on the other area. In similar fashion, an image of a person or animal may be imaged on one area while a closeup photo of the person or animal is imaged on the other area.

In another embodiment, the invention provides a blank that is comprised of a single-ply or sheet of paper having four removable rectangular sections disposed in discrete areas of the sheet. In addition, each removable section is provided with fold lines and lines of weakening to divide the section into sub-sections.

In addition, adhesive is disposed over the backside of the various sub-sections while removable liners are disposed over the adhesive areas in order to protect the adhesive. Accordingly, the liner may be provided with a layer of silicone or other release material to be peelable from the adhesive on the sub-section. In addition, a second adhesive, for example, in the form of glue dots, are provided on each of the four corner sub-sections of two aligned removable sections or permanent securement to the backing layer disposed thereover for removable therewith.

The blank is sized to be imaged or printed, for example, in an ink-jet printer or laser printer or any other suitable type of device, to have various pictorial representations or text or photographs made on each of the four removable sections and particularly within one or more of the sub-sections.

After imaging, the blank is processed so that each backing liner is removed from the back of the blank to expose the adhesive. At the same time, one of the liners also removes four corner sub-sections from each of two aligned removable sections to provide "windows" in these sections.

Next, the sheet of paper is folded about a longitudinal line of weakening to secure the pairs of removable sections on each half of the sheet of paper over the removable sections of the other half of the sheet of paper. The windows which are provided in two of the sections thus expose the adhesive on the opposed surfaces of the other sections.

Next, the sheet of paper is folded about a transverse line of weakening to secure the folded sections and four corner sub-sections together.

Finally, the removable sections are removed as a single unit from the remainder of the blank to define a novelty product having multiple foldable sections.

Formation of the novelty product from a single sheet of paper allows the paper to be readily imaged with whatever pictorial representations are to be displayed when the novelty product has been manipulated by a user.

These and other objects and advantages of the invention will become more apparent from the following detailed description taken in conjunction with the accompanying drawings wherein.

Figure 1:
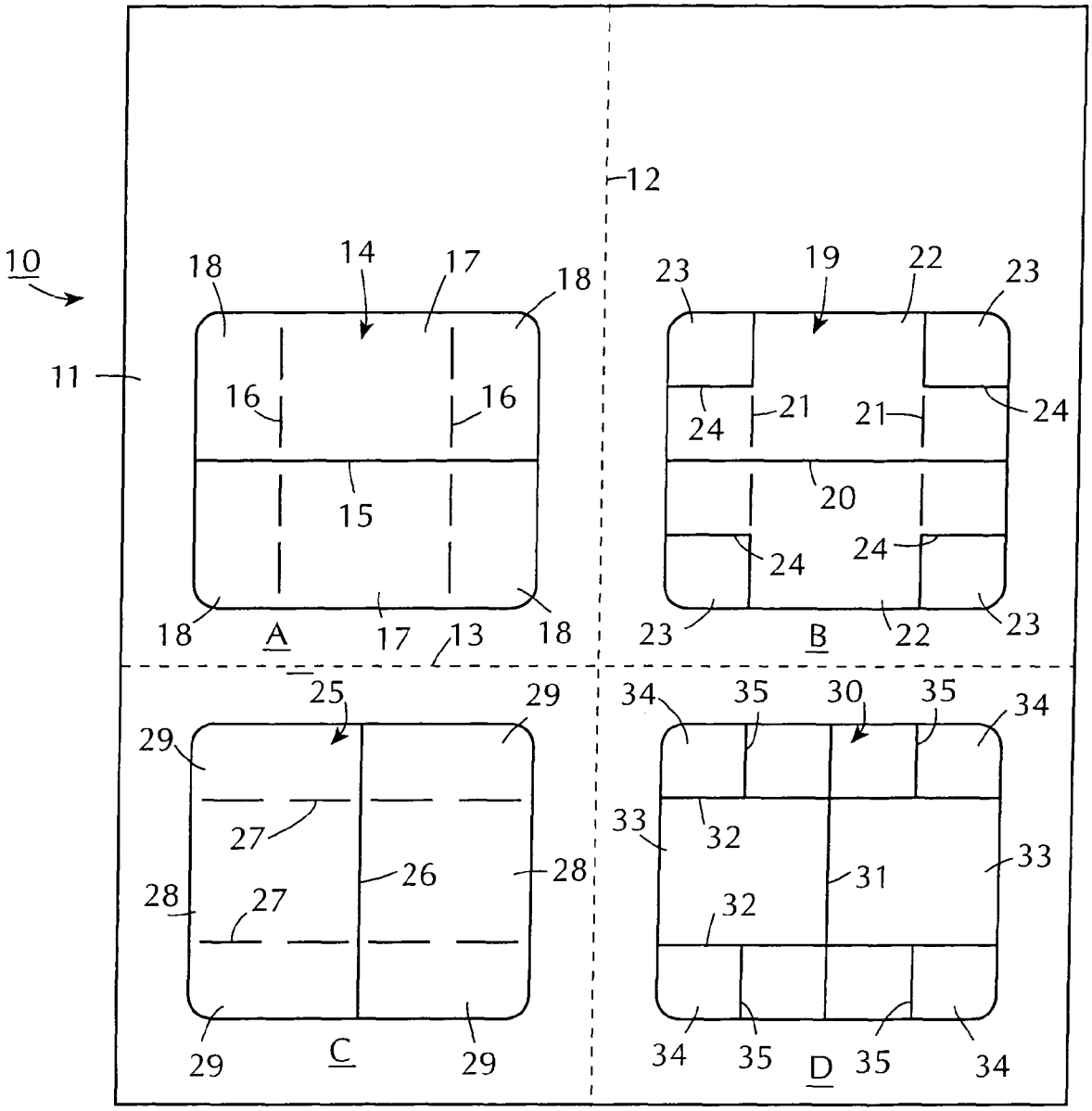
FIG. 1 illustrates a front view of a blank for making a novelty product in accordance with the invention.

Referring to FIG. 1, the blank 10 is comprised of a single sheet of paper 11 having a longitudinally disposed line of weakening 12 to divide the sheet 11 in half and a transverse line of weakening 13 extending across the sheet 11 to define four areas A, B, C, D within the sheet 11.

The first area A has a removable rectangular section 14 defined by a die-cut, perforations, or by slits with rupturable ties or the like suitable to allow the section 14 to be subsequently removed. The section 14 includes a slit line 15 with or without rupturable ties perpendicular to the longitudinal line 12 to divide the section 14 in half. In addition, the rectangular section 14 includes a pair of interrupted lines of weakening 16 parallel to the longitudinal line 12 and perpendicular to the slit line 15. Each interrupted line 16 has four spaced-apart segments to divide the section 14 into a pair of main sub-sections 17 and two pairs of side sub-sections 18.

Area B is disposed on an opposite side of the longitudinal line 12 from area A and has a removable rectangular section 19 including a slit line 20 perpendicular to the longitudinal line 12 to divide the section 19 in half. In addition, the section 19 has a pair of interrupted lines of weakening 21 parallel to the longitudinal line 12 and perpendicular to the slit line 20. Each interrupted line 21 has four spaced-apart segments to divide the section 19 into a pair of main sub-sections 22 and two pairs of side sub-sections 23. In addition, a slit line 24 with or without rupturable ties is provided in each side sub-section 23 to divide the side sub-section 23 in half.

Area C, which is on the same side of the longitudinal line 12 as section A, has a removable third section 25 including a slit line 26 parallel to the longitudinal line 12 to divide the section 25 in half. In addition, the section 25 has a pair of interrupted lines of weakening 27 perpendicular to the longitudinal line 12 and perpendicular to the slit line 26. Each interrupted line 27 has four spaced-apart segments to divide the section 25 into a pair of main sub-sections 28 and two pairs of side sub-sections 29.

The fourth area D is disposed on an opposite side of the longitudinal line 12 from area C and has a removable fourth rectangular section 30 including a slit line 31 parallel to the longitudinal line 12 to divide the section 30 in half. In addition, the section 30 has a pair of interrupted lines of weakening 32 perpendicular to the longitudinal line 12 and perpendicular to the slit line 31. Each interrupted line 32 has four spaced-apart segments to divide the section 30 into a pair of main sub-sections 33 and two pairs of side sub-sections 34. A slit line 35 with or without rupturable ties is provided in each sub-section 34 to divide the sub-section 34 in half.

Figure 2:
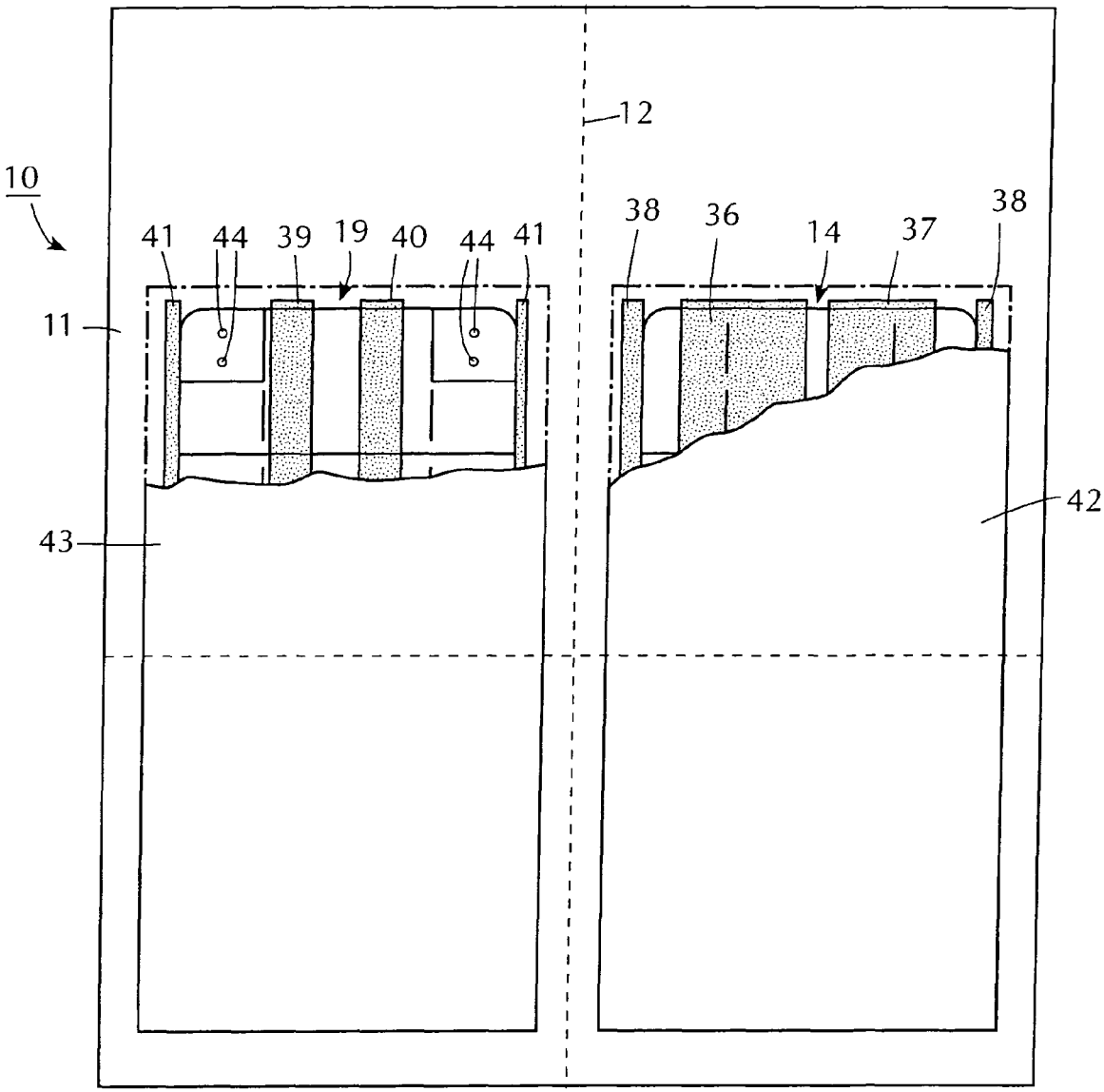
FIG. 2 illustrates a view of the back side of the blank of FIG. 2.

Referring to FIG. 2, adhesive is disposed over the back of the sheet of paper 11 in patterns, for example, stripes, to cover over selected sub-sections of each removable section 14, 19, 25, 30. Specifically, two parallel continuous stripes 36, 37 of adhesive are applied over the removable sections 14, 25 to substantially cover all of the sub-sections thereof. As indicated, the two stripes 36, 37 of adhesive are parallel to the longitudinal line 12 of the sheet 11. Two narrower stripes of adhesive 38 are disposed in parallel to the stripes 36, 37 outside the plane of the removable sections 14, 25 for purposes as described below. Alternatively, the adhesive may be applied to fully cover the areas of the sections 14,19,25,30 that are to be laminated together.

A pair of narrower parallel stripes of adhesive 39, 40 are disposed over the removable sections 19, 30. As indicated, these stripes of adhesive 39, 40 are parallel to the longitudinal line of weakening 12 of the sheet 11. Each strip of adhesive 39, 40 is of a width to cover over only one half of a main sub-section 22 of the removable section 19 and the middle half of the removable section 30. Additional lines of adhesive 41 are provided in parallel to the lines of adhesive 39, 40 and are located outside the plane of the removable sections 19, 30 for purposes as described below.

Alternatively, stripes of adhesive may also be applied over the remaining sub-sections of the removable sections 19, 30 to enhance adhesive securement of the various sections together as explained below.

Referring to FIG. 2, a pair of removable backing sheets or liners 42, 43 are provided to protect the adhesive on the sheet of paper 11. Each removable backing 42, 43 is particularly held in place by the strips of adhesive 36, 37, 39, 40 and by the strips of adhesive 38, 41 alongside the removable sections 14, 19. The backing sheets 42, 43 may be made of any suitable material, such as a silicone-coated paper. Alternatively, the two backing sheets 42, 43 may be replaced by a single backing sheet.

As indicated in FIG. 2, additional adhesive 44 in the form of a pair of dots 44 is applied to the sub-sections at the four corners of the removable sections 19, 30. These adhesive dots 44 serve to secure one-half of each sub-section 23, 34 (FIG. 1) to the backing sheet 43 in a permanent manner.

In order to form a novelty product, the two backing sheets 42, 43 are removed from the back of the blank 10 to expose the adhesive strips. During removal of the backing sheet 43, one-half of each side sub-section 23 of the removable sections 19, 30 is simultaneously removed. Upon removal of each corner of the removable section 19, 30, a "window" is formed.

Thereafter, the sheet of paper 11 is folded about the longitudinal line of weakening 12 to adhesively secure sections 14 and 19 over each other and sections 25 and 30 over each other. At this time, the windows provided in the sections 19, 30 expose the adhesive on the four corners of the opposite sections 14, 25.

Next, the sheet 11 is folded about the transverse line of weakening 13 to adhesively secure four corners of the first section 14 to and over four corners of the third section 25. In this respect, the windows provided by the two sections 19, 30 allow communication between the adhesive on the exposed surfaces of the sections 14, 25.

Thereafter, the four folded-over sections are removed from the sheet of paper 11 to define a novelty product having a four-layer construction with multiple foldable sections.

Once formed, the product may be folded about the now aligned slit lines 15, 20 of the first and second section 14,19 to break apart each of the sections 14, 19 into two halves and then folded about the slit lines 26,31 of the third and fourth sections 25,30 to separate each of the sections 25, 30 into two halves.

The product may then be manipulated by a user by folding about the slit lines 15, 26 to expose the different sub-sections to thereby present a rectangular pictorial representation, which may change, depending upon the sub-sections exposed to view.

The product may be printed with indicia on each of the four sections 14, 19, 25, 30 that are coordinated to each other so as to present coordinated scenes on the foldable sections of the product.

Figure 3:
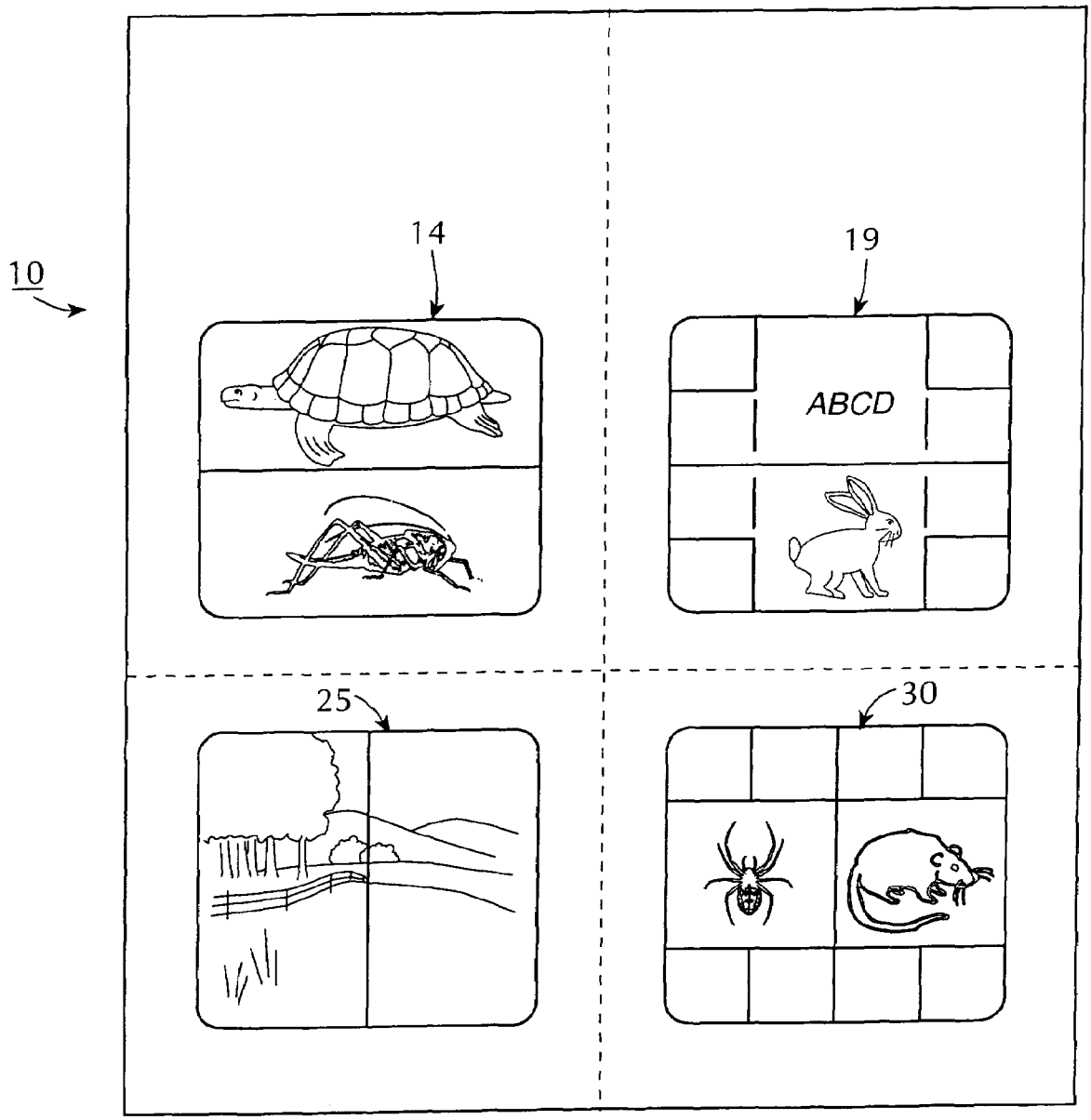
FIG. 3 illustrates a view similar to FIG. 1 of a blank having pictoral representations formed on the four removable sections.

Referring to FIG. 3, each removable section 14, 19, 25, 30 is provided with a different pictorial representation from the other. When folded and manipulated by a user, different scenes may be depicted from time to time.

The blank may be formed with eight or more removable sections in order to form two or more multi-layer products rather than only one product. Also, the removable sections may be oriented on the blank in any suitable manner to be imaged, folded over onto another removable section and removed.

The blank may be formed with the removable sections and printed in any suitable fashion. For example, the blank may be pre-die cut or post die cut, printed and adhesively coated. Alternatively, the blank may be printed, then die cut and then adhesively coated and folded. Still further, the blank may be die cut, printed and personalized and then glued and folded.

While the novelty product is illustrated as being of rectangular shape, other shapes are also possible such as oval and circular.

A plurality of blanks may be provided to a consumer who would then print the information desired on the removable sections and then process the form into a plurality of products, each with the same or different imaging. For example, for forwarding to different ultimate consumers.

In another embodiment, the blank may be formed with one or more pairs of separated areas about a fold line with each area having a removable section. For example, one section may have a pictoral representation while the other section has text related to the pictoral representation. In this embodiment, adhesive is applied over one or preferably both removable sections along with a removable backing sheet or sheets as above. After removal of the backing sheet or sheets, the blank is folded about the fold line to laminate the two sections together into a two-ply card that can then be removed from the folded blank.

One advantage of the latter embodiment is that the alignment of the two sections over and onto each other can be readily achieved by a simple folding step.

Figure 4:
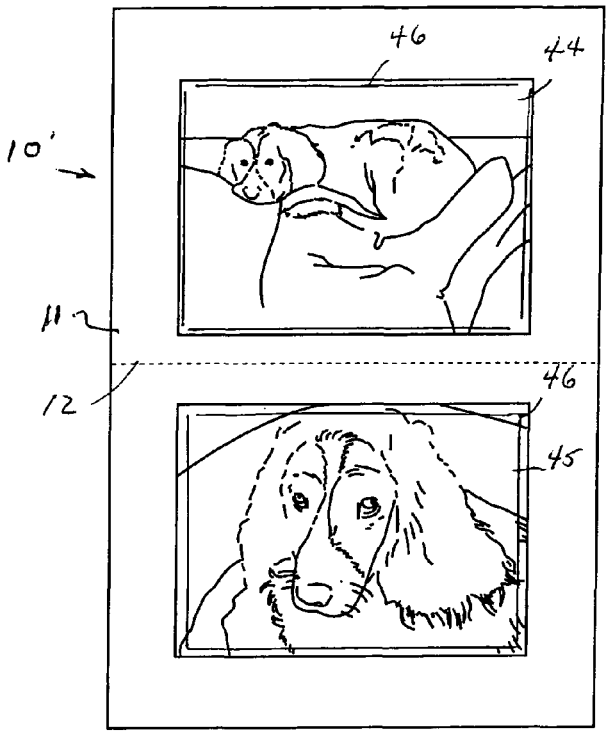
FIG. 4 illustrates a second embodiment of a blank for making a novelty product in accordance with the invention.
Figure 5:
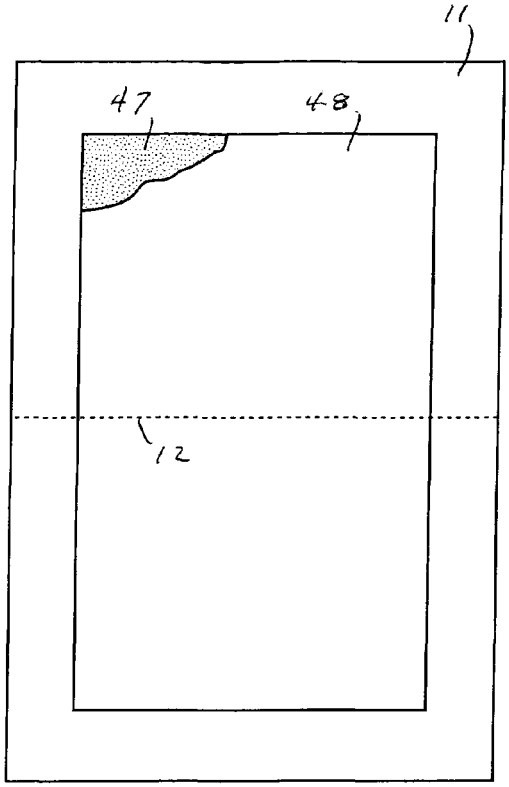
FIG. 5 illustrates a back view of the blank of FIG. 4.

Referring to FIGS. 4 and 5, where in like reference characters indicate like parts as above, the blank 10' is comprised of a single sheet of paper 11 having a transversely disposed line of weakening 12 to divide the sheet 11 into two sections of the same or different sizes.

The upper section of the sheet of paper 11 has a rectangular area 44 that is provided with imaging while the lower section has an area 45 that is provided with imaging different from but related to the imaging on the area 44 on the upper section.

Each section 44, 45 is die-cut to form a weakened frame 46, for example, in a rectangular shape with right angle corners, so as to be removable from the remainder of the sheet of paper 11. Typically, each removable section 44,45 is made smaller than the area of the imaging so that the outer borders of the imaging defines a border about the removable section 44,45.

Referring to FIG. 5, a layer of adhesive 47 is applied to the back side of one or both of the removable sections 44, 45 and a removable liner 48 of conventional type is disposed over the layer or layers of adhesive 47. As shown, the removable liner 48 is of smaller height and width than the sheet of paper 11. Where the adhesive layer 47 is applied to only one of the removable sections 44, 45, the liner 48 would be sized only to fit over that layer of adhesive. Alternatively, adhesive spots may be used to secure the removable sections in place. Also, two separate liners may be used instead of the one liner 48.

In order to form a novelty product, the blank 10' fed into a laser printer or other suitable imaging device in order to have imaging applied to the front surface of the blank 10' as indicated in FIG. 4. In the illustrated example, imaging includes a photo of a reclining dog on the upper section and a closeup photo of the reclining dog on the lower section.

Figure 6:
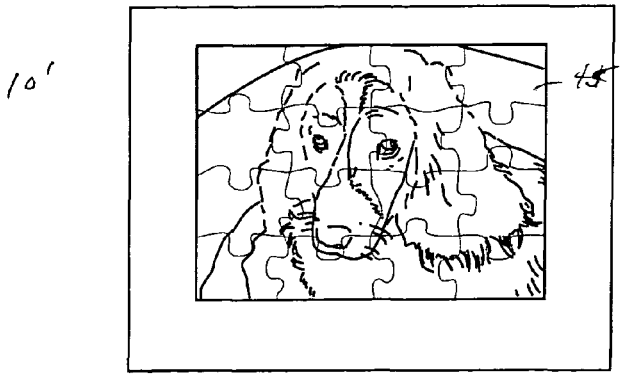
FIG. 6 illustrates the blank of FIG. 4 after folding and die-cutting in accordance with the invention.

After imaging, the liner 48 is removed in order to expose the layer of adhesive 47. The blank 10' is then folded about the line of weakening or fold line 12 as indicated in FIG. 6 so as to bring the two sections 44, 45 into registration. Pressing the two sections 44,45 of the blank 10' together effects a lamination of the two sections 44, 45 in back-to-back relation.

Thereafter, the folded over blank 10' is die-cut to define a jig-saw pattern in the laminated sections 44, 45 as illustrated in FIG. 6.

Figure 7:
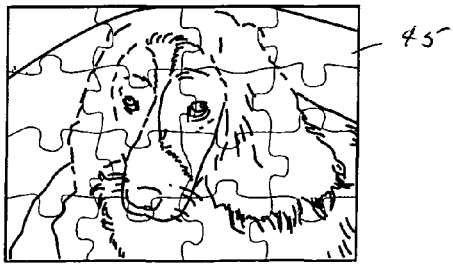
FIG. 7 illustrates the laminated removable sections removed from the blank of FIG. 4 after processing.

Thereafter, the laminated sections 44, 45 are removed from the remainder of the blank 10' by punching out along the die-cut frame 46 thereby forming a two-sided puzzle as indicated in FIG. 7.

In still another embodiment, the blank may be in the form of a continuous web on a roll, with or without a fold line, that can be printed and processed into a series of novelty products. For example, a continuous web may be printed and then separated at intervals to form discrete pieces that may then be folded to form one or more novelty products. Also, the web may be processed without the separating step to form a continuous stream from which the novelty products may then be removed.

In still another embodiment, a blank may be die-cut to provide a pop-up construction in the finished product. In this embodiment, the blank is formed to be folded about a longitudinal line to divide the blank into two sections with each section being die-cut to have a first weakened frame as above and a second weakened frame. After imaging of at least the first frame within each section and removal of the removable liner or liners to expose the adhesive, the blank would be folded on itself to laminate the respective weakened frames together. Next, this laminated product is removed from the remainder of the blank and folded in three so that the imaged first frames are disposed between two halves of the laminated second frames.

Depending on die-cuts and fold lines within each of the now laminated together second weakened frames, the free ends of the second frames are then secured together as by an adhesive thereon to form a flat structure. Upon unfolding of the two outer layers of this structure about a mid-point of each, the laminated and imaged inner layer of the structure is then popped through a preformed slot formed between the two outer layers into an upstanding position while precut portions of the outer layers pop out to form lateral supports for the upstanding inner layer.

Of note, text may be imaged within each of the second weakened frames.

The invention thus provides a single blank which can be readily imaged in conventional imaging equipment, such as laser printers, on one side only and readily folded to create a laminated product with imaging of two sides with the feel of one sheet of paper. The laminated product may then be removed from the remainder of the blank and used for various purposes.

A user may also process a plurality of blanks, for example, to create individual and team trading cards for Little League players and the like as well as for sales promotions and public relation pieces.

The invention further provides a blank that can be used to create four-sided dimensional puzzles for product promotions, business cards and company presentations. Such products may also be used as invitations, party favors, memory cards, birth announcements, and the like.

What is claimed is:

1. A blank for making a novelty product, said blank comprising a sheet of paper having a longitudinally disposed line of weakening to divide said sheet in half and a transverse line of weakening extending across said sheet to define four areas within said sheet;

a first of said areas on one side of said longitudinal line having a removable rectangular section including a slit line perpendicular to said longitudinal line to divide said section in half, a pair of interrupted lines of weakening parallel to said longitudinal line and perpendicular to said slit line, each interrupted line having four spaced apart segments to divide said section into a pair of main sub-sections and two pair of side sub-sections;

a second of said areas on an opposite side of said longitudinal line from said first area having a removable second rectangular section including a slit line perpendicular to said longitudinal line to divide said second section in half, a pair of interrupted lines of weakening parallel to said longitudinal line and perpendicular to said slit line, each interrupted line having four spaced apart segments to divide said second section into a pair of main sub-sections and two pair of side sub-sections, and a slit line in each side sub-section to divide said side sub-section in half;

a third of said areas on said one side of said longitudinal line having a removable rectangular third section including a slit line parallel to said longitudinal line to divide said third section in half, a pair of interrupted lines of weakening perpendicular to said longitudinal line and perpendicular to said slit line thereof, each interrupted line having four spaced apart segments to divide said third section into a pair of main sub-sections and two pair of side sub-sections; and a fourth of said areas on an opposite side of said longitudinal line from said third area having a removable fourth rectangular section including a slit line parallel to said longitudinal line to divide said fourth section in half, a pair of interrupted lines of weakening perpendicular to said longitudinal line and perpendicular to said slit line thereof, each interrupted line having four spaced apart segments to divide said fourth section into a pair of main sub-sections and two pair of side sub-sections, and a slit line in each side sub-section thereof to divide said side sub-section in half;

at least a first liner disposed over said first and third rectangular sections;

at least a second liner disposed over said second and fourth rectangular sections;

a layer of adhesive on each area for releaseably holding a respective liner thereon; and adhesive means securing one-half of each side sub-section of said second and fourth sections to said second liner for removal with said second liner.

2. A blank as set forth in claim 1 wherein said layer of adhesive on said first and third areas covers each of said main sub-sections and said side sub-sections thereof and said layer of adhesive on said second and fourth areas covers only said main sub-sections thereof.

3. A blank as set forth in claim 1 which further comprises a first adhesive-free strip on said sheet parallel to said longitudinal line of weakening and extending centrally of said first and third sections and a second adhesive-free strip on said sheet parallel to said longitudinal line of weakening and extending centrally of said second and fourth sections.

4. A blank for making at least one laminated novelty product, said blank comprising a sheet of paper having a first transverse line of weakening to divide said sheet in half to define at least two areas within said sheet;

a first of said areas on one side of said line having a removable first section within said first area and spaced from edges of said first area for receiving imaging thereon;

a second of said areas on an opposite side of said line from said first area having a removable second section within said second area and spaced from said first section for folding over and onto said first area and for receiving imaging thereon related to the imaging on said first section;

a layer of adhesive on each of said sections for laminating said sections to each other; and a removable liner disposed over said adhesive on each of said sections for removal therefrom to permit folding of said first section and said second section over each other to allow said adhesive to laminate said first removable section with said second removable section.

5. A blank as set forth in claim 4 which further includes at least one second line of weakening transverse to said first line of weakening to define a third area and a fourth area within said sheet for folding, said third area being disposed on an opposite side of said second line from said first area and said fourth area being disposed on an opposite side of said second line from said second area, said third area having a removable section therein and said fourth section having a removable section for folding over and onto said removable section of said third area.

6. A blank for making a novelty product, said blank comprising a sheet of paper having a first line of weakening to divide said sheet in half to define at least two areas within said sheet;

a first of said areas on one side of said line having a removable first section within said first area and spaced from edges of said first area for receiving imaging thereon;

a second of said areas on an opposite side of said line from said first area having a removable second section within said second area and spaced from said first section for folding over and onto said first area, said second section having imaging thereon related to the imaging on said first section;

at least one second line of weakening transverse to said first line of weakening to define a third area and a fourth area within said sheet for folding, said third area being disposed on an opposite side of said second line from said first area and said fourth area being disposed on an opposite side of said second line from said second area, said third area having a removable section therein and said fourth section having a removable section for folding over and onto said removable section of said third area;

a layer of adhesive on at least one of said first and said second sections for laminating said first and said second sections to each other;

a removable liner disposed over said layer of adhesive;

a layer of adhesive on at least one of said third and fourth sections for laminating said sections to each other; and a removable liner disposed over said adhesive on said at least one of said third and fourth sections.

7. A blank as set forth in claim 6 wherein each of said removable sections of said second and fourth areas have sub-sections adhered to said liner for removal therewith to provide windows in said removable sections of said second and fourth areas for exposure of adhesive therethrough.

8. A blank for making a novelty product, said blank comprising a sheet of paper having at least two areas within said sheet;

a first of said areas having a removable first section within said first area and spaced from edges of said first area for receiving imaging on a front surface thereof from an imaging device;

a second of said areas having a removable second section within said second area and spaced from said first section for folding over and onto said first area and for receiving imaging on a front surface thereof from the imaging device related to the imaging on said first section;

an adhesive on at least one of said sections for laminating said sections to each other in back-to-back relation; and a removable liner disposed over said adhesive on said one section for removal therefrom to permit folding of said first section and said second section over each other to allow said adhesive to laminate said first removable section with said second removable section.

9. A blank as set forth in claim 8 having a fold line disposed transversely between said sections for folding of said sections onto each other.

10. A blank as set forth in claim 8 characterized in being made of photo quality water resistant material.

11. A blank for making a novelty product, said blank comprising a sheet of paper having a longitudinally disposed line of weakening to divide said sheet in half and a transverse line of weakening extending across said sheet to define four areas within said sheet;

a first of said areas on one side of said longitudinal line having a removable section including a slit line perpendicular to said longitudinal line to divide said section in half, a pair of interrupted lines of weakening parallel to said longitudinal line and perpendicular to said slit line, each interrupted line having four spaced apart segments to divide said section into a pair of main sub-sections and two pair of side sub-sections;

a second of said areas on an opposite side of said longitudinal line from said first area having a removable second section including a slit line perpendicular to said longitudinal line to divide said second section in half, a pair of interrupted lines of weakening parallel to said longitudinal line and perpendicular to said slit line, each interrupted line having four spaced apart segments to divide said second section into a pair of main sub-sections and two pair of side sub-sections, and a slit line in each side sub-section to divide said side sub-section in half;

a third of said areas on said one side of said longitudinal line having a removable third section including a slit line parallel to said longitudinal line to divide said third section in half, a pair of interrupted lines of weakening perpendicular to said longitudinal line and perpendicular to said slit line thereof, each interrupted line having four spaced apart segments to divide said third section into a pair of main sub-sections and two pair of side sub-sections; and a fourth of said areas on an opposite side of said longitudinal line from said third area having a removable fourth section including a slit line parallel to said longitudinal line to divide said fourth section in half, a pair of interrupted lines of weakening perpendicular to said longitudinal line and perpendicular to said slit line thereof, each interrupted line having four spaced apart segments to divide said fourth section into a pair of main sub-sections and two pair of side sub-sections, and a slit line in each side sub-section thereof to divide said side sub-section in half;

a liner disposed over said sections;

a layer of adhesive on each area for releaseably holding said liner thereon; and adhesive means securing one-half of each side sub-section of said second and fourth sections to said liner for removal with said liner.

12. A blank as set forth in claim 11 wherein each said section is rectangular.

13. A blank for making at least one laminated novelty product, said blank comprising a sheet of paper for passage through an imaging device;

a first area on said sheet to receive imaging thereon and having a removable first section smaller than and within said first area;

a second area on said sheet to receive imaging thereon related to the imaging on said first area and having a removable second section smaller than and within said second area for folding over and onto said first area;

an adhesive directly on at least one of said removable sections for laminating said removable sections to each other; and a removable liner disposed over said adhesive on said one removable section for removal therefrom to permit folding of said first area and said second area over each other to allow said adhesive directly to laminate said first removable section with said second removable section.

14. A blank as set forth in claim 13 wherein each of said first removable section and said second removable section is die cut to form a weakened frame to be removable from the remainder of said sheet.

15. A blank as set forth in claim 13 further comprising an adhesive on each of said removable sections and a pair of removable liners, each said liner being disposed over a respective adhesive on a each respective removable sections for removal therefrom.

16. A blank for making at least one laminated novelty product, said blank comprising a sheet of paper having a fold line to separate at least two areas within said sheet;

a first of said areas on one side of said fold line having a removable first section therein spaced from said fold line for receiving imaging thereon;

a second of said areas on an opposite side of said fold line from said first area having a removable second section therein spaced from said first section and said fold line for folding over and onto said first area and for receiving imaging thereon related to the imaging on said first section; and an adhesive only on one of said removable sections for laminating said sections to each other upon folding of said first section and said second section about said fold line and onto each other and without laminating the remainder of said first area to said second area whereby after lamination of said sections to each other the laminated sections are removable from said sheet.

17. A blank as set forth in claim 16 further comprising a removable liner disposed over said adhesive on said one section for removal therefrom to permit folding of said first section and said second section into registration with each other to allow said adhesive to laminate said first removable section with said second removable section.

18. A blank as set forth in claim 17 wherein said removable liner is of smaller height and width than said sheet of paper.

19. A blank for making at least one laminated novelty product, said blank comprising a sheet of paper having a fold line to separate two areas within said sheet;

a first of said areas on one side of said fold line having a removable first section therein spaced from said fold line for receiving imaging thereon;

a second of said areas on an opposite side of said fold line from said first area having a removable second section therein spaced from said first section and said fold line for folding over and onto said first area and for receiving imaging thereon related to the imaging on said first section; and an adhesive only on each of said removable sections for laminating said sections to each other upon folding of said first section and said second section about said fold line and onto each other and without laminating the remainder of said first area to said second area.

20. A blank for making a novelty product, said blank comprising a sheet of paper having a longitudinally disposed line of weakening to divide said sheet in half and a transverse line of weakening extending across said sheet to define four areas within said sheet;

a first of said areas on one side of said longitudinal line having a removable rectangular section including a slit line perpendicular to said longitudinal line to divide said section in half, a pair of interrupted lines of weakening parallel to said longitudinal line and perpendicular to said slit line, each interrupted line having four spaced apart segments to divide said section into a pair of main sub-sections and two pair of side sub-sections;

a second of said areas on an opposite side of said longitudinal line from said first area having a removable second rectangular section including a slit line perpendicular to said longitudinal line to divide said second section in half, a pair of interrupted lines of weakening parallel to said longitudinal line and perpendicular to said slit line, each interrupted line having four spaced apart segments to divide said second section into a pair of main sub-sections and two pair of side sub-sections, and a slit line in each side sub-section to divide said side sub-section in half;

a third of said areas on said one side of said longitudinal line having a removable rectangular third section including a slit line parallel to said longitudinal line to divide said third section in half, a pair of interrupted lines of weakening perpendicular to said longitudinal line and perpendicular to said slit line thereof, each interrupted line having four spaced apart segments to divide said third section into a pair of main sub-sections and two pair of side sub-sections; and a fourth of said areas on an opposite side of said longitudinal line from said third area having a removable fourth rectangular section including a slit line parallel to said longitudinal line to divide said fourth section in half, a pair of interrupted lines of weakening perpendicular to said longitudinal line and perpendicular to said slit line thereof, each interrupted line having four spaced apart segments to divide said fourth section into a pair of main sub-sections and two pair of side sub-sections, and a slit line in each side sub-section thereof to divide said side sub-section in half.

21. A blank as set forth in claim 20 further comprising an adhesive on a back side of said sheet of paper, said adhesive being disposed on each of said main sub-sections of each said area.

22. A blank for making a novelty product, said blank comprising a sheet of paper having a first line of weakening to divide said sheet in half to define at least two areas within said sheet;

a first of said areas on one side of said line having a removable first section within said first area and spaced from edges of said first area for receiving imaging thereon;

a second of said areas on an opposite side of said line from said first area having a removable second section within said second area and spaced from said first section for folding over and onto said first area, said second section having imaging thereon related to the imaging on said first section;

at least one second line of weakening transverse to said first line of weakening to define a third area and a fourth area within said sheet, said third area being disposed on an opposite side of said second line from said first area and said fourth area being disposed on an opposite side of said second line from said second area, said third area having a removable section therein and said fourth section having a removable section for folding over and onto said removable section of said third area;

a layer of adhesive on at least one of said first and said second sections for laminating said first and said second sections to each other; and a layer of adhesive on at least one of said third end fourth sections for laminating said sections to each other.

23. A blank as set forth in claim 22 wherein each of said removable sections of said second and fourth areas have removable sub-sections therein to provide windows in said removable sections of said second and fourth areas for exposure of said adhesive on said first and third areas therethrough.

* * * * *